US006192561B1

(12) United States Patent
Bennett

(10) Patent No.: US 6,192,561 B1
(45) Date of Patent: Feb. 27, 2001

(54) CARTRIDGE CASE FORMER AND METHOD

(76) Inventor: Ronald B. Bennett, 3664 Pheasant Run, Bloomfield Hills, MI (US) 48302

( * ) Notice: Subject to any disclaimer, the term of this patent is extended or adjusted under 35 U.S.C. 154(b) by 0 days.

(21) Appl. No.: 09/212,919

(22) Filed: Dec. 16, 1998

(51) Int. Cl.[7] ..... B21D 51/54

(52) U.S. Cl. ..... 29/1.3; 86/1.1; 86/36; 72/118; 72/126

(58) Field of Search ..... 86/1.1, 23, 24, 86/36–38; 29/1.3, 1.31, 1.32; 102/464, 468; 72/115, 118, 126

(56) References Cited

U.S. PATENT DOCUMENTS

| | | | | |
|---|---|---|---|---|
| 1,665,915 | * | 4/1928 | Ekman | 72/126 |
| 2,332,704 | | 10/1943 | Enes et al. . | |
| 3,685,475 | * | 8/1972 | Banks, Jr. | 72/69 |
| 3,705,515 | | 12/1972 | Lee . | |
| 3,815,397 | * | 6/1974 | Hollencamp | 72/126 |
| 3,818,563 | | 6/1974 | Beaulieu . | |
| 3,890,682 | | 6/1975 | Eckstein . | |
| 3,979,995 | | 9/1976 | Phillips . | |
| 4,133,248 | | 1/1979 | Phillips . | |
| 4,133,249 | | 1/1979 | Bachhuber et al. . | |
| 4,325,282 | | 4/1982 | Schaenzer . | |
| 4,593,598 | | 6/1986 | Gunder . | |
| 4,723,472 | | 2/1988 | Lee . | |
| 5,515,766 | | 5/1996 | Fleury . | |
| 5,635,661 | | 6/1997 | Tuftee . | |
| 5,649,465 | | 7/1997 | Beebe . | |
| 5,727,295 | | 3/1998 | Gracey . | |
| 5,755,815 | | 5/1998 | Kochanek . | |

FOREIGN PATENT DOCUMENTS

| | | | | |
|---|---|---|---|---|
| 405161932 | * | 6/1993 | (JP) | 72/126 |
| 143682 | * | 4/1961 | (RU) | 29/1.32 |

* cited by examiner

*Primary Examiner*—Harold J. Tudor
(74) *Attorney, Agent, or Firm*—Bliss McGlynn, P.C.

(57) ABSTRACT

A cartridge case former and method includes a front arbor plate, a rear arbor plate and a plurality of arbors extending between the front arbor plate and the rear arbor plate. The cartridge case former also includes a plurality of rotatable roller dies disposed about the arbors for forming a neck of a cartridge case.

12 Claims, 3 Drawing Sheets

CARTRIDGE CASE FORMER AND METHOD

BACKGROUND OF THE INVENTION

1. Field of the Invention

The present invention relates generally to cartridges for guns and, more particularly, to a cartridge case former and method of forming a cartridge case for a cartridge.

2. Description of the Related Art

It is known to provide cartridges for guns. Typically, the cartridge includes a cylindrical case made from a brass cylinder, which has a rim with a primer pocket, extractor groove, body, tapered shoulder, neck and mouth. The cartridge also includes a primer disposed in the primer pocket, powder disposed within the body and a bullet disposed in the end of the neck.

The cartridge cases are manufactured in standard sizes. However, some gun operators desire non-standard or "special" cartridges for shooting. To make such cartridges, a standard cartridge case is put into a cartridge-resizing die and the neck is expanded or contracted. The neck may then be reamed internally or externally with a reamer to a desired size.

Although the above special cartridge cases have worked well, they suffer from the disadvantage that several dies and reamers are required to size the neck. Another disadvantage is that the resizing is labor intensive and relatively costly. As a result, there is a need in the art to provide a device and method for forming a neck of a cartridge case to a desired size.

SUMMARY OF THE INVENTION

It is, therefore, one object of the present invention to provide a cartridge case former.

It is another object of the present invention to provide a cartridge case former which roll forms a neck of a cartridge case to a predetermined size.

It is yet another object of the present invention to provide a method of roll forming a neck of a cartridge case.

To achieve the foregoing objects, the present invention is a cartridge case former. The cartridge case former includes a front arbor plate, a back arbor plate and a plurality of arbors extending between the front arbor plate and the back arbor plate. The cartridge case former also includes a rotatable roller die disposed about each arbor for roll forming a neck of a cartridge case.

Additionally, the present invention is a method of roll forming a neck of a cartridge case. The method includes the steps of providing a cartridge case, providing a plurality of roller dies and rotating at least either the cartridge case or the roller dies. The method also includes the steps of moving the cartridge case between the roller dies and reducing the neck of the cartridge case to a predetermined size.

One advantage of the present invention is that a cartridge case former is provided for forming a cartridge case. Another advantage of the present invention is that the cartridge case former forms a neck of a standard cartridge case to a non-standard predetermined size. Yet another advantage of the present invention is that the cartridge case former roll forms a standard cartridge case to make a non-standard or special cartridge case. Still another advantage of the present invention is that a method is provided of roll forming a neck of a cartridge case.

Other objects, features and advantages of the present invention will be readily appreciated as the same becomes better understood after reading the subsequent description when considered in connection with the accompanying drawings.

DESCRIPTION OF THE PREFERRED EMBODIMENT(S)

Figure 1:
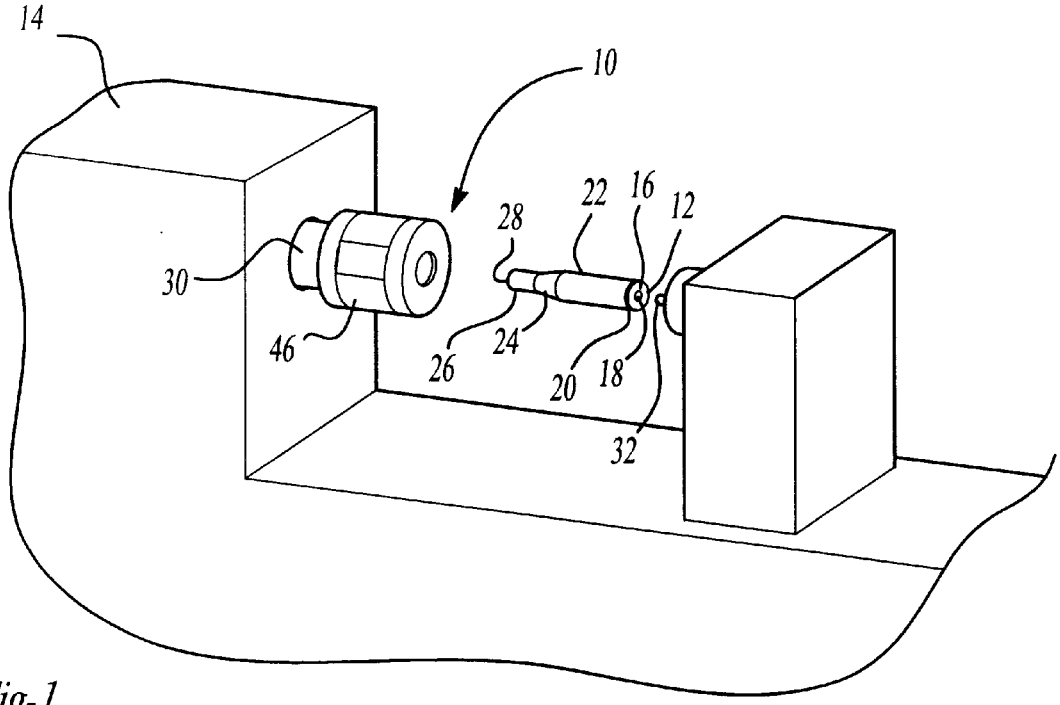
FIG. 1 is a perspective view of a cartridge case former, according to the present invention, illustrated in operational relationship with a cartridge case and a lathe.

Referring now to the drawings and in particular to FIG. 1, one embodiment of a cartridge case former 10, according to the present invention, is illustrated in operational relationship with a cartridge case 12 and lathe 14. The cartridge case 12 is generally cylindrical in shape and made of a metal material such as brass. The cartridge case 12 includes a rim 16 having a primer pocket 18, an extractor groove 20, a body 22, a tapered shoulder 24, a neck 26 and a mouth 28. It should be appreciated that the cartridge case 12 is of a standard size in the art. It should also be appreciated that, prior to forming with the cartridge case former 10, the cartridge case 12 is conventional and known in the art.

The lathe 14 includes a headstock 30 such as a chuck, which is rotated by a source (not shown), of the lathe 14. The lathe 14 also includes a tailstock 32 such as a center. The cartridge case former 10 is mounted to the headstock 30 and the cartridge case 12 is mounted to the tailstock 32. The tailstock 32 is moved toward the headstock 30 and the cartridge case 12 is engaged with the cartridge case former 10 to form the neck 26 of the cartridge case 12 to a predetermined size. It should be appreciated that the cartridge case 12 could be mounted to the headstock 30 and the cartridge case former 10 could be mounted to the tailstock 32. It should also be appreciated that the lathe 14 is conventional and known in the art.

Figure 3:
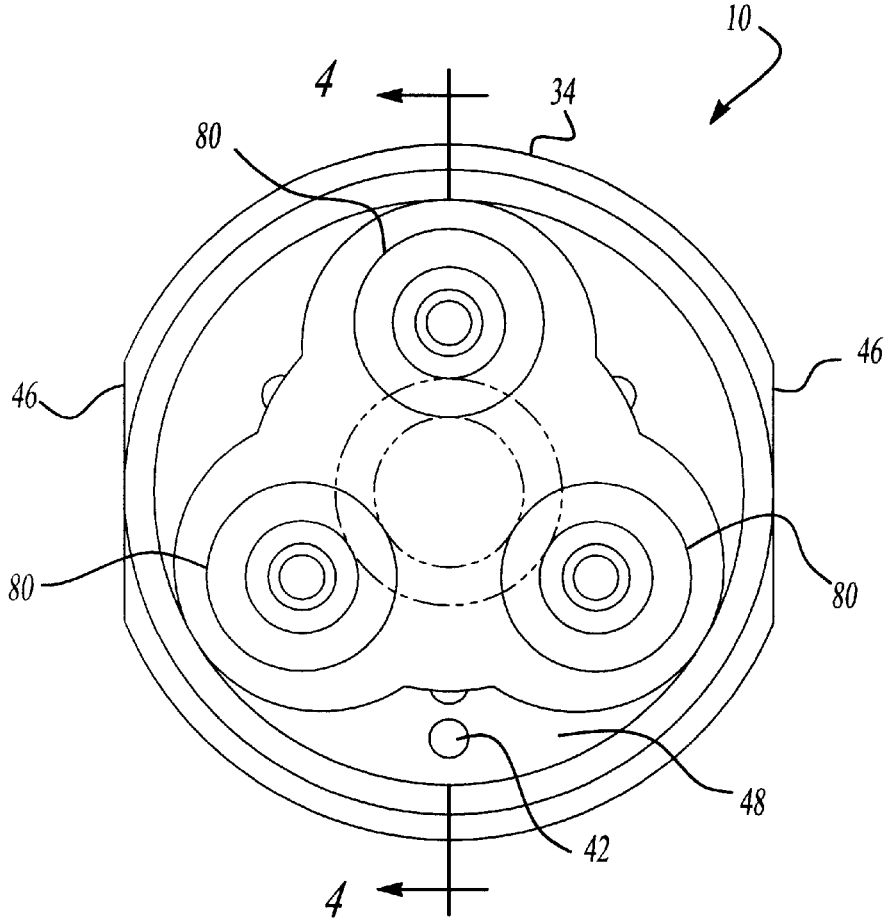
FIG. 3 is an end view of the cartridge case former of FIG. 1.
Figure 2:
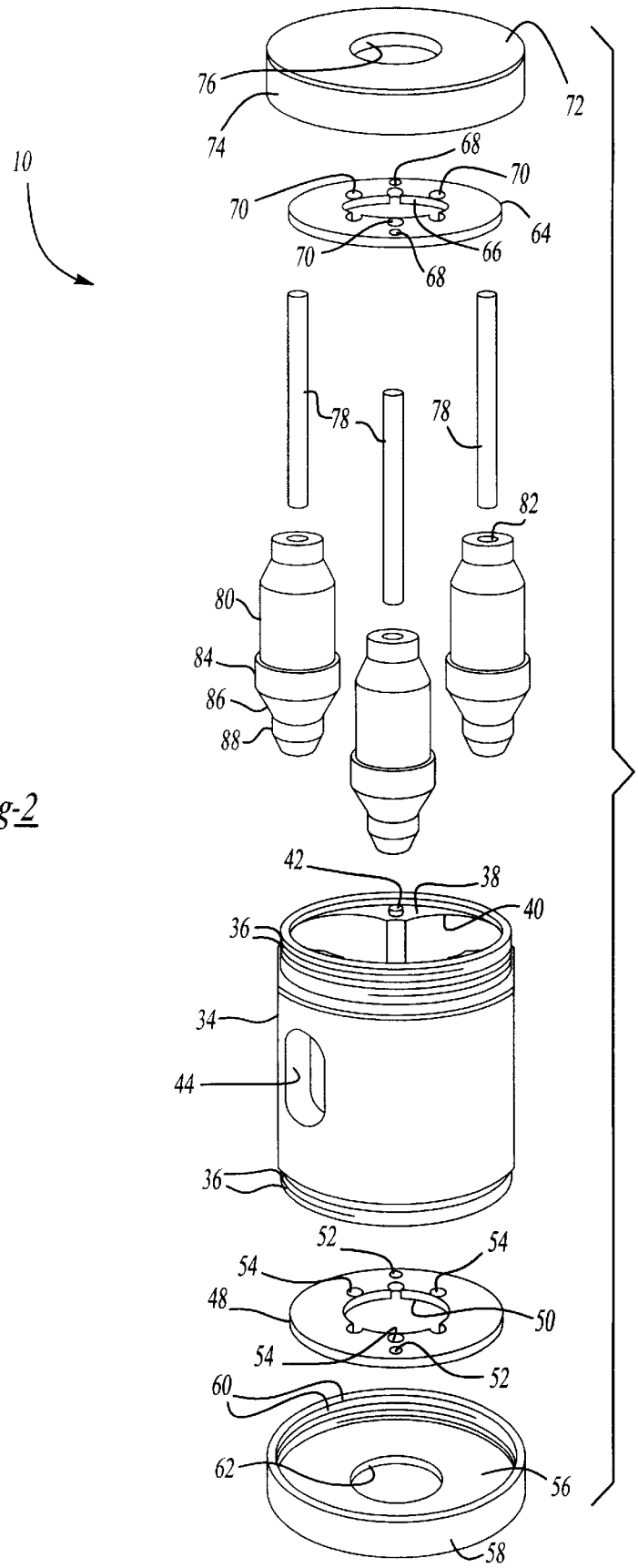
FIG. 2 is an exploded view of the cartridge case former of FIG. 1.

Referring to FIGS. 1 through 3, the cartridge case former 10 includes an arbor housing 34. The arbor housing 34 is generally cylindrical in shape. The arbor housing 34 extends axially and is generally circular in cross-sectional shape. The arbor housing 34 is made of a metal material such as aluminum. The arbor housing 34 has a plurality of external threads 36 on each axial end. The arbor housing 34 also has an interior portion 38 recessed axially from each axial end. The interior portion 38 has a passageway 40 formed in a generally triangular or cloverleaf pattern and extending axially therethrough. The arbor housing 34 also includes a protrusion 42 extending axially from the interior portion 34 at each axial end for a function to be described. The arbor housing 34 may include an elongated slot 44 extending radially therethrough for visual inspection by an operator. The arbor housing 34 may also include a pair of opposed flat portions 46 extending axially on an outer surface thereof to allow an operator to turn the cartridge case former 10 with a wrench (not shown).

Figure 4:
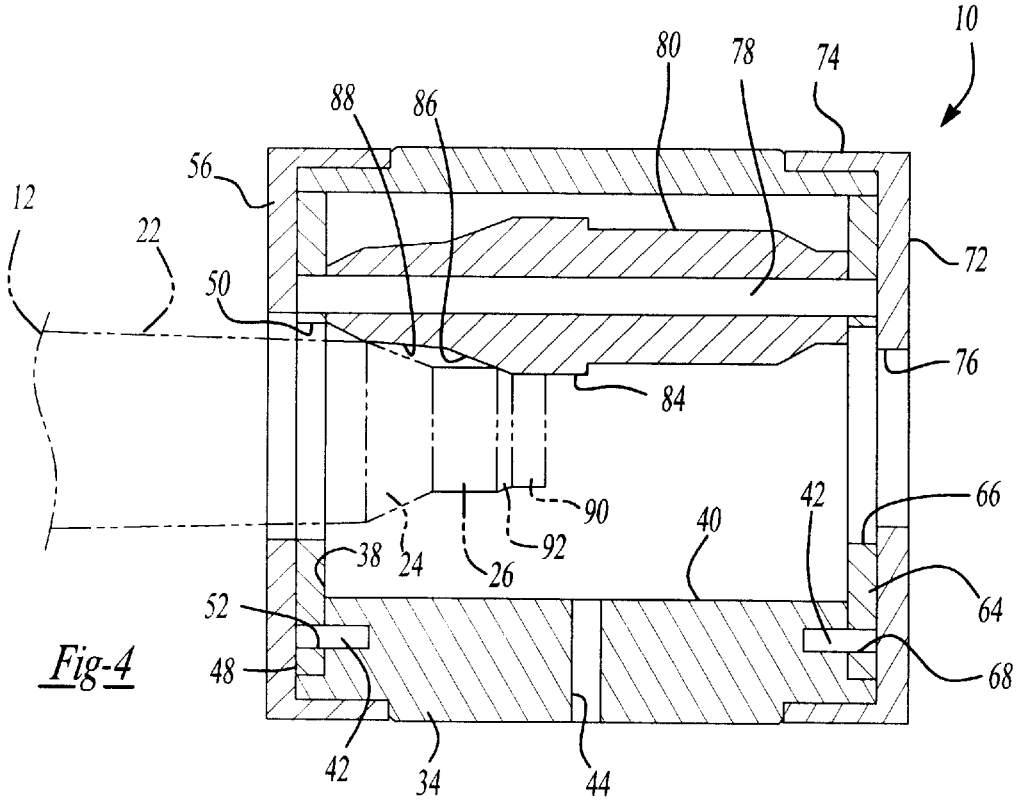
FIG. 4 is a sectional view taken along line 4—4 of FIG. 3 illustrating initial forming of a neck of the cartridge case of FIG. 1.

Referring to FIGS. 2 through 4, the cartridge case former 10 includes a first or front arbor plate 48 mounted to one axial end of the arbor housing 34. The front arbor plate 48 is generally planar and circular in shape. The front arbor plate 48 has a central aperture 50 extending axially therethrough and is generally circular in shape. The front arbor plate 48 is made of a metal material such as aluminum. The front arbor plate 48 has at least one, preferably a pair of opposed locator apertures 52 extending axially therethrough between an outer periphery and the central aperture 50. Either one of the locator apertures 52 receives the protrusion 42 on the interior portion 38 of the arbor housing 34. The front arbor plate 48 also includes a plurality of, preferably three arbor apertures 54 extending axially therethrough and spaced about the central aperture 50 between the outer periphery and the central aperture 50 for a function to be described. It should be appreciated that the front arbor plate 48 is of a size and thickness to be disposed within the arbor housing 34 adjacent to the interior portion 38 and substantially flush with the axial end of the arbor housing 34.

The cartridge case former 10 includes a first or front arbor cap 56 mounted to one axial end of the arbor housing 34. The front arbor cap 56 is generally planar and circular in shape. The front arbor cap 56 has an annular flange 58 extending generally perpendicular therefrom. The annular flange 58 has a plurality of internal threads 60 for threadably engaging the external threads 36 on one axial end of the arbor housing 34. The front arbor cap 56 is made of a metal material such as aluminum. The front arbor cap 56 also includes an aperture 62 extending axially therethrough and being circular in shape for a function to be described.

The cartridge case former 10 includes a second or back arbor plate 64. The back arbor plate 64 is generally planar and circular in shape. The back arbor plate 64 has a central aperture 66 extending axially therethrough and is generally circular in shape. The back arbor plate 64 is made of a metal material such as aluminum. The back arbor plate 64 has at least one, preferably a pair of opposed locator apertures 66 extending axially therethrough between an outer periphery and the central aperture 64. Either one of the locator apertures 66 receives the protrusion 42 on the interior portion 38 of the arbor housing 34. The back arbor plate 64 also includes a plurality of, preferably three arbor apertures 68 extending axially therethrough and spaced about the central aperture 66 between the outer periphery and the central aperture 66 for a function to be described. It should be appreciated that the back arbor plate 64 is of a size and thickness to be disposed within the arbor housing 34 adjacent to the interior portion 38 and is substantially flush with the axial end of the arbor housing 34.

The cartridge case former 10 includes a second or back arbor cap 72 mounted to the other axial end of the arbor housing 34. The back arbor cap 72 is generally planar and circular in shape. The back arbor cap 72 has an annular flange 74 extending generally perpendicular therefrom. The annular flange 74 has a plurality of internal threads (not shown) for threadably engaging the external threads 36 on the other end of the arbor housing 34. The back arbor cap 72 is made of a metal material such as aluminum. The back arbor cap 72 also includes an aperture 76 extending axially therethrough and being circular in shape for a function to be described.

The cartridge case former 10 also includes a plurality of, preferably three arbors 78 extending between the front arbor plate 48 and the back arbor plate 64. The arbors 78 are generally cylindrical and circular in cross-sectional shape. The arbors 78 extend axially and have one end disposed in one of the arbor apertures 54 of the front arbor plate 48 and the other end disposed in a corresponding arbor aperture 70 of the back arbor plate 64. The arbors 78 are made of a metal material such as aluminum.

The cartridge case former 10 includes a plurality of, preferably three rotatable roller dies 80. The roller dies 80 are generally cylindrical and circular in cross-sectional shape. The roller dies 80 are made of a metal material such as aluminum. The roller dies 80 have an aperture 82 extending axially therethrough and being generally circular in shape for receiving the arbors 78. It should be appreciated that the roller dies 80 rotate about the arbors 78.

The roller dies 80 include a neck portion 84 of an enlarged diameter to roll form the neck 26 of the cartridge case 12 to a predetermined size or diameter The roller dies 80 also include a tapered portion 86 to form the tapered shoulder 24 of the cartridge case 12. The roller dies 80 further include a body portion 88 which is inclined slightly to roll form an upper portion of the body 22 of the cartridge case 12. It should be appreciated that one roller die 80 is disposed about one arbor 78.

To assemble the cartridge case former 10, one roller die 80 is disposed about one arbor 78. The roller dies 80 and arbors 78 are orientated such that one end of each arbor 78 is disposed in one of the arbor apertures 52 of the front arbor plate 48. The front arbor plate 48 is located adjacent the arbor housing 34 such that each roller die 80 is disposed in the passageway 40 of the interior portion 38 and the protrusion 42 is disposed in either one of the locator apertures 52. The front arbor cap 58 is then threaded onto the arbor housing 34. Next, the rear arbor plate 64 is located adjacent the arbor housing 34 such that each arbor 78 is located in the arbor apertures 70 and the protrusion 42 is disposed in either one of the locator apertures 68. The rear arbor cap 72 is then threaded onto the arbor housing 34 .

Figure 5:
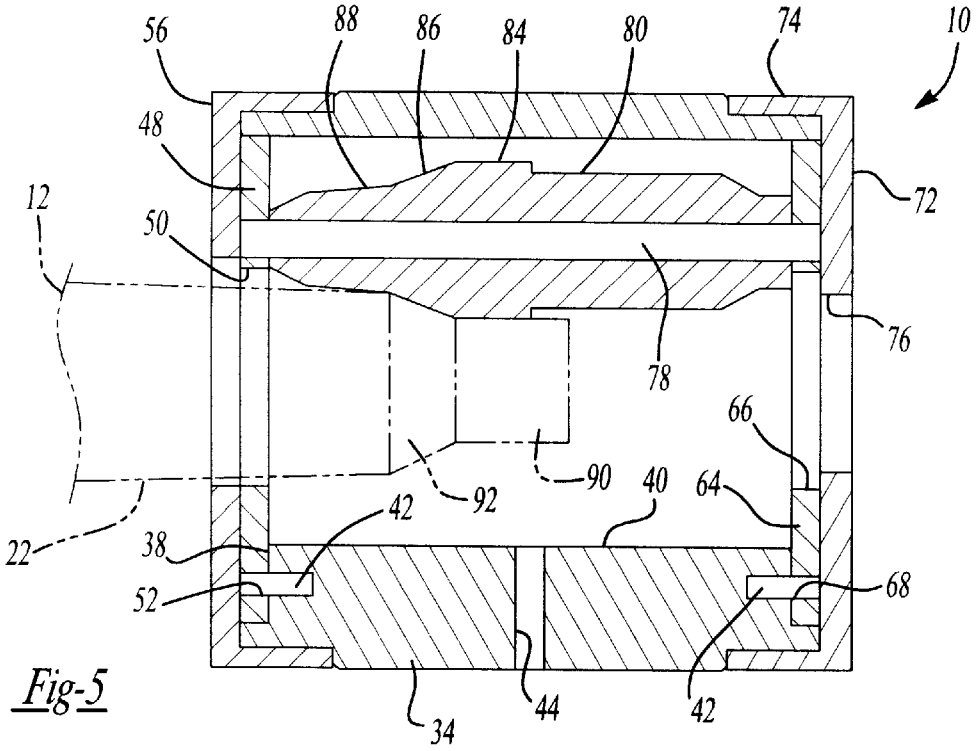
FIG. 5 is a view similar to FIG. 4 illustrating final forming of a neck of the cartridge case of FIG. 1.

In operation, the cartridge case former 10 is mounted to the headstock 30 of the lathe 14 as illustrated in FIG. 1. The cartridge case 12 is mounted to the tailstock 32 of the lathe 14. As illustrated in FIGS. 4 and 5, the cartridge case 12 enters the rotating cartridge case former 10 through the aperture 62 in the front arbor cap 58 and into the passageway 40 of the arbor housing 34 between the roller dies 80. The three roller dies 80 are self-centering on the cartridge case 12. The tapered portion 86 and neck portion 84 of the roller dies 80 contact the neck 26 and tapered shoulder 24 of the cartridge case 12 to reduce it and form a secondary neck 90 and secondary tapered shoulder 92 as illustrated in FIG. 4. The cartridge case 12 is moved axially further into the cartridge case former 10 until the secondary neck 90 and secondary tapered shoulder 92 become the final reduced neck and tapered shoulder of the cartridge case 12. The cartridge case 10 is then allowed to air cool.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A cartridge case former comprising:

a housing;

a front arbor plate disposed within said housing;

a back arbor plate disposed within said housing;

a plurality of arbors disposed within said housing and extending between said front arbor plate and said back arbor plate; and a plurality of generally cylindrical rotatable roller dies disposed within said housing and about said arbors, each roller die having an enlarged generally cylindrical portion for roll forming a neck of a cartridge case and having a tapered portion for roll forming a tapered shoulder of the cartridge case.

2. A cartridge case former as set forth in claim 1 wherein said roller dies are three in number.

3. A cartridge case former as set forth in claim 1 wherein said housing has an interior portion with a passageway extending axially therethrough, said roller dies being disposed in said passageway.

4. A cartridge case former as set forth in claim 3 wherein said passageway is generally cloverleaf shaped.

5. A cartridge case former as set forth in claim 1 wherein said cartridge case former is made of metal.

6. A method of roll forming a neck of a cartridge case, said method comprising the steps of:

providing a cartridge case;

providing a cartridge case former having a housing, a front arbor plate disposed within said housing, a back arbor plate disposed within said housing, a plurality of arbors disposed within said housing and extending between said front arbor plate and said back arbor plate, and a plurality of generally cylindrical rotatable roller dies disposed within said housing and about said arbors, each roller die having an enlarged generally cylindrical portion for roll forming a neck of a cartridge case and having a tapered portion for roll forming a tapered shoulder of the cartridge case;

rotating at least either the cartridge case or the roller dies; and moving the cartridge case between the roller dies and reducing the neck of the cartridge case to a predetermined size.

7. A method as set forth in claim 6 wherein said step of moving comprises moving the cartridge case axially between the dies.

8. A method as set forth in claim 6 wherein said step of providing a cartridge case comprises providing a cartridge case with a neck having a predetermined diameter.

9. A method as set forth in claim 8 wherein said step of reducing comprises reducing the neck of the cartridge case to a diameter less than the predetermined diameter of the cartridge case.

10. A method as set forth in claim 6 wherein said step of providing a cartridge case former comprises providing three roller dies spaced from each other.

11. A method as set forth in claim 6 wherein said step of providing a cartridge case former comprises providing a plurality of roller dies having an enlarged diameter neck portion to reduce the neck of the cartridge case.

12. A method as set forth in claim 6 wherein said step of rotating comprises rotating only the cartridge case former.

* * * * *